US010634037B2

(12) United States Patent
Ekman et al.

(10) Patent No.: US 10,634,037 B2
(45) Date of Patent: Apr. 28, 2020

(54) COOLER ARRANGEMENT FOR COOLING AT LEAST ONE CYLINDER OF A COMBUSTION ENGINE

(71) Applicant: SCANIA CV AB, Södertälje (SE)

(72) Inventors: Mats Ekman, Nykvarn (SE); Zoltan Kardos, Södertälje (SE); Richard Jansson, Mölnbo (SE); Stig Hildahl, Södertälje (SE); Magnus Carlsson, Södertälje (SE)

(73) Assignee: Scania CV AB, Södertälje (SE)

( * ) Notice: Subject to any disclaimer, the term of this patent is extended or adjusted under 35 U.S.C. 154(b) by 661 days.

(21) Appl. No.: 15/037,729

(22) PCT Filed: Dec. 3, 2014

(86) PCT No.: PCT/SE2014/051444
§ 371 (c)(1),
(2) Date: May 19, 2016

(87) PCT Pub. No.: WO2015/094086
PCT Pub. Date: Jun. 25, 2015

(65) Prior Publication Data

US 2016/0298522 A1 Oct. 13, 2016

(30) Foreign Application Priority Data

Dec. 20, 2013 (SE) ..... 1351555

(51) Int. Cl.
*F01P 3/00* (2006.01)
*F01P 3/02* (2006.01)
(Continued)

(52) U.S. Cl.
CPC ..... *F01P 3/02* (2013.01); *F01P 3/14* (2013.01); *F01P 3/16* (2013.01); *F01P 2003/027* (2013.01); *F01P 2003/028* (2013.01)

(58) Field of Classification Search
CPC ..... F02F 1/40; F02F 1/14; F01P 3/02
(Continued)

(56) References Cited

U.S. PATENT DOCUMENTS 3,315,652 A * 4/1967 Ries ..... F02F 1/4285 123/41.31
4,121,550 A * 10/1978 Wand ..... F02F 1/40 123/41.31
(Continued)

FOREIGN PATENT DOCUMENTS

DE 10212672 A1 10/2003
DE 102006006121 A1 8/2007
(Continued)

OTHER PUBLICATIONS

European Search Report from the European Patent Office for PCT/SE2014/051444 dated Jun. 20, 2017.
(Continued)

*Primary Examiner* — Long T Tran
*Assistant Examiner* — James J Kim
(74) *Attorney, Agent, or Firm* — Moore & Van Allen PLLC; W. Kevin Ransom

(57) ABSTRACT

Disclosed is a cooler arrangement for cooling a cylinder of a combustion engine. The cylinder has a cylinder head and a cylinder liner. The arrangement comprises a cooling circuit with a first flow passage which leads coolant through a lower part of the cylinder head, a second flow passage which leads coolant through an upper part of the cylinder head, and a third flow passage which leads coolant through an upper part of the cylinder liner. The cooling circuit is adapted to initially leading coolant through the first flow passage before it is led in parallel through the second flow passage and the third flow passage.

9 Claims, 2 Drawing Sheets

(51) Int. Cl.
*F01P 3/14* (2006.01)
*F01P 3/16* (2006.01)

(58) Field of Classification Search
USPC ..... 123/41.02, 41.08, 41.1, 41.29, 41.31, 123/41.74, 41.82 R
See application file for complete search history.

(56) References Cited

U.S. PATENT DOCUMENTS

| | | | | | |
|---|---|---|---|---|---|
| 4,889,080 | A * | 12/1989 | Oguri | F02F 1/40 | 123/41.82 R |
| 4,911,109 | A * | 3/1990 | Kawamura | F01P 3/02 | 123/193.3 |
| 7,086,355 | B2 * | 8/2006 | Yamamoto | F01P 3/02 | 123/41.72 |
| 7,520,257 | B2 * | 4/2009 | Adams | F02F 1/40 | 123/193.5 |
| 7,647,900 | B2 * | 1/2010 | Hayashi | F01P 3/02 | 123/41.72 |
| 8,939,115 | B2 * | 1/2015 | Dees | F02F 1/40 | 123/193.5 |
| 8,939,116 | B2 * | 1/2015 | Poschl | F02F 1/40 | 123/193.5 |
| 2004/0173168 | A1 * | 9/2004 | Obermayer | F02F 1/40 | 123/41.31 |
| 2005/0235931 | A1 * | 10/2005 | Zahdeh | F02F 1/108 | 123/41.74 |
| 2009/0165298 | A1 * | 7/2009 | Nagafuchi | B22C 9/103 | 29/888.06 |
| 2009/0229543 | A1 * | 9/2009 | Suzuki | F01N 5/02 | 123/41.02 |
| 2011/0214627 | A1 * | 9/2011 | Nishikawa | F01P 7/04 | 123/41.02 |
| 2012/0090565 | A1 * | 4/2012 | Beyer | F01N 3/046 | 123/41.82 R |
| 2013/0213322 | A1 * | 8/2013 | Takeuchi | F01P 3/02 | 123/41.1 |
| 2014/0196674 | A1 * | 7/2014 | Quix | F01P 7/14 | 123/41.09 |
| 2016/0153344 | A1 * | 6/2016 | Jones | F02F 1/242 | 123/41.08 |

FOREIGN PATENT DOCUMENTS

| | | | |
|---|---|---|---|
| DE | 102007037744 | A1 | 2/2009 |
| FR | 2860833 | A1 | 4/2005 |
| GB | 191304555 | A | 4/1913 |
| WO | 2012101014 | A1 | 8/2012 |
| WO | WO2012101014 | A1 | 8/2012 |
| WO | 2013118410 | A1 | 8/2013 |

OTHER PUBLICATIONS

Scania CV AB, International Application No. PCT/SE2014/051444, International Preliminary Report on Patentability, dated Jun. 21, 2016.
International Search Report for PCT/SE2014/051444 dated Mar. 25, 2015.

* cited by examiner

COOLER ARRANGEMENT FOR COOLING AT LEAST ONE CYLINDER OF A COMBUSTION ENGINE

CROSS-REFERENCE TO RELATED APPLICATIONS

This application is a national stage application (filed under 35 § U.S.C. 371) of PCT/SE2014/051444, filed Dec. 3, 2014 of the same title, which, in turn, claims priority to Swedish Application No. 1351555-6, filed Dec. 20, 2013 of the same title; the contents of each of which are hereby incorporated by reference.

FIELD OF THE INVENTION

The present invention relates to a cooler arrangement for cooling at least one cylinder of a combustion engine comprising a cooling circuit with three flow passages which lead coolant through a cylindrical head and a cylindrical liner.

BACKGROUND OF THE INVENTION

Combustion processes in the cylinders of a combustion engine result in the generation of thermal energy which warms regions adjacent to the combustion space, e.g. cylinder heads and cylinder liners. Such regions situated nearest to the combustion space, e.g. the lower part of the cylinder head, reach a higher temperature than those at a greater distance from the combustion space, e.g. the lower part of the cylinder liner. Warmer and cooler zones therefore occur in cylinder heads and cylinder liners during operation of a combustion engine. In operating situations where the engine is under heavy load for a lengthy period the warmer zones may reach very high temperatures.

Conventional cooling systems for cooling of combustion engines circulate coolant which may be at a temperature within the range 80-90° C. during normal operation. When the coolant circulates through the engine, cooling ducts provide all cooled zones in the engine with cooling by coolant at substantially the same temperature and flow. In operating situations where an engine is under heavy load, the cooling may become deficient in the warmest zones of the cylinder head and the cylinder liner. Other zones where there is less thermal load will be provided with cooling which may result in prolonged engine warm-up time after a cold start.

WO 2012/101014 refers to a cooling system with a circulating coolant for cooling a cylinder head of a combustion engine. The system has an inlet line which conveys the coolant initially to a central region of a lower cooling chamber in the cylinder head. This lower chamber has radial ducts which lead the coolant radially outwards. The coolant is received in an annular duct from which it passes upwards via an aperture to an upper cooling chamber in the cylinder head The coolant is thereafter led away from the cylinder head via an outlet duct.

SUMMARY OF THE INVENTION

The object of the present invention is to propose a cooler arrangement capable of providing differentiated cooling of different parts of a cylinder according to their respective cooling requirements.

This object is achieved with the cooler arrangement defined in the introduction which is characterized by the features indicated in the characterizing part of the claim 1. Different parts of a cylinder require cooling which is substantially related to how much thermal energy they receive from a combustion process. The cooling effect which a circulating coolant imparts is related to its temperature and flow. According to the invention all of the coolant is initially led to a first flow passage which extends through the lower part of the cylinder head where the cooling requirement is greatest. The coolant may here be at its lowest temperature while at the same time its flow is optimum. The lower part of the cylinder head is thus provided with optimum cooling by the coolant.

The cooling circuit thereafter divides into two parallel flow passages, viz. a second flow passage which leads coolant through an upper part of the cylinder head, and a third flow passage which leads the coolant to an upper part of the cylinder liner. An advantage of such a parallel flow is that the pressure losses in the cooling circuit will be small. The coolant flow through the respective parallel flow passages will however be less than in the first coolant passage, while at the same time the coolant will be at a higher temperature after it has cooled the lower part of the cylinder head. The upper part of the cylinder head and the upper part of the cylinder liner are thus cooled by coolant at a smaller flow and higher temperature than that which cools the lower part of the cylinder head. The upper part of the cylinder head and the upper part of the cylinder liner are therefore provided with less cooling than the lower part of the cylinder head. This is a simple way of achieving differentiated cooling between the lower part of the cylinder head and adjacent parts which do not require the same cooling. This differentiated cooling is achieved with a cooling circuit in which the coolant is circulated with relatively small pressure losses.

In one embodiment of the present invention the second flow passage and the third flow passage are so dimensioned that there will be a greater flow of coolant through the third flow passage than the second flow passage. In this case coolant passes at the same temperature but at different flows through the upper part of the cylinder head and the upper part of the cylinder liner. By dimensioning the flow of coolant through the upper part of the cylinder head and the upper part of the cylinder liner it is possible to achieve a suitable ratio of cooling effect between them. As the cooling requirement is greater in the upper part of the cylinder liner than in the upper part of the cylinder head, the largest portion of the coolant flow is therefore led through the upper part of the cylinder liner. The result is a further differentiation of the cylinder's cooling effect depending on the cooling requirements of its respective parts.

In one embodiment of the present invention the coolant from the second flow passage and the coolant from the third flow passage come together in an outlet duct situated at a lower level than said flow passages. This means that there will be no region where stationary coolant and any pollutants in the coolant might accumulate in said flow passages.

In one embodiment of the present invention the cooler arrangement has a fourth flow passage which leads a cooling medium through a lower part of the cylinder liner, thus also providing cooling in this part of the cylinder. The cooling requirement in this part of the cylinder will be less than in the parts mentioned above. The cooler arrangement will thus provide the smallest coolant effect in this part of the cylinder. The cooler arrangement may in this case also lead coolant from the first flow passage parallel to the fourth flow passage, which will be dimensioned to receive a smaller flow of coolant than that in the parallel second flow passage and the parallel third flow passage.

In one embodiment of the present invention the cooler arrangement may have a separate cooling circuit which leads a cooling medium through the fourth flow passage. Such a separate cooling circuit may lead a cooling medium in the form of coolant, gearbox oil or motor oil through the fourth flow passage. An advantage of having a separate cooling circuit is that it may be activated only when the engine has reached an intended operating temperature after a cold start. An initial lack of cooling of the lower part of the cylinder liner will enable the engine to warm up more quickly to the intended operating temperature. The friction losses which occur when the engine is below the intended operating temperature may thus be reduced.

In one embodiment of the present invention said first flow passage comprises ducts which lead a parallel flow of coolant through the lower part of the cylinder head. Such parallel ducts make it possible for the coolant to be distributed in a desired way over substantially the whole lower part of the cylinder head and/or be concentrated to regions where cooling is prioritized. The parallel ducts may be made quite short, causing the coolant to undergo little pressure drop through the first flow passage. The second coolant passage may also comprise a plurality of ducts which lead coolant in parallel through the upper part of the cylinder head. The third flow passage and the fourth flow passage may be situated in a circular bulkhead between cylinder liner and cylinder block.

In one embodiment of the present invention said first flow passage provides coolant flow close to all of the inlet ducts and exhaust ducts in the cylinder head. It is important that the components mentioned above which are situated in the cylinder head be not exposed to too high temperatures. Said first flow passage may provide coolant flow close to an injector in the cylinder head. The injector will be so situated in the cylinder head as to be subject to great thermal action during a combustion process. The injector will also comprise movable parts which need good cooling to prevent their being subject to thermal action which might affect their operation. The first flow passage may have at least one vertical duct which leads coolant in a vertical direction close to the injector. Such a vertical duct may with advantage surround the injector. An injector which has an elongate shape may thus be provided with good cooling. The coolant in such a vertical duct may be received in any of the ducts which extend through the upper part of the cylinder head.

BRIEF DESCRIPTION OF THE DRAWINGS

Preferred embodiments of the invention are described below by way of examples with reference to the attached drawings, in which.

DETAILED DESCRIPTION OF PREFERRED EMBODIMENTS OF THE INVENTION

Figure 1:
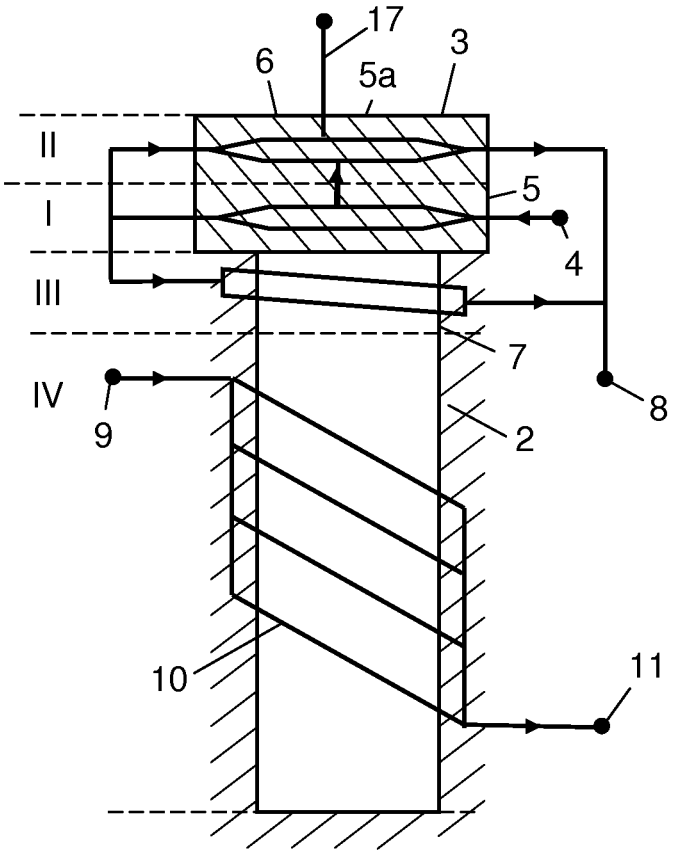
FIG. 1 depicts a cooler arrangement according to a first embodiment of the invention.

FIG. 1 depicts a cylinder 1 of a combustion engine which may be situated in a vehicle and may be a diesel engine. The cylinder comprises in a conventional way a cylindrical space containing an undepicted movable piston. The sidewalls of the cylinder are defined as a cylinder liner 2. The cylinder is bounded upwards by a lower surface of a cylinder head 3. During combustion processes in the cylinder, combustion takes place in a combustion space in an upper part of the cylinder between an upper surface of the piston and the lower surface of the cylinder head. A lower part of the cylinder head, herein referred to as a first zone I, will receive most thermal energy from the combustion process. An upper part of the cylinder head, herein referred to as a second zone II, will receive less thermal energy than the first zone I. An upper part of the cylinder liner 2 which substantially constitutes the sidewalls of the combustion space, herein referred to as a third zone III, will receive the next most thermal energy from a combustion process. A lower part of the cylinder liner which is situated at a lower level and is herein referred to as a fourth zone IV will undergo relatively moderate warming during a combustion process. All of the zones I-IV close to the cylinder do however need to be cooled during operation of the engine to enable the latter to operate in an optimum way and with low fuel consumption.

A cooler arrangement is adapted to providing differentiated cooling of said zones I-IV of the cylinder 1. It comprises a cooling circuit with circulating coolant. The cooling circuit may be part of a cooling system which cools the engine and possibly other components of the vehicle. The coolant may be cooled in a radiator in the front section of the vehicle before being led back to said cooling circuit. The cooling circuit receives coolant from an inlet line 4. The coolant is led initially to a first flow passage which comprises a plurality of parallel first ducts 5 which extend in parallel through the lower part of the cylinder head 3 and are arranged in such a way that the material and the components of the whole first zone I are provided with substantially uniform cooling.

After the coolant has passed through the first zone I, part of the coolant flow is led to a second flow passage which comprises a plurality of parallel ducts 6 in the upper part of the cylinder head 3 which are arranged in such a way as to provide substantially uniform cooling throughout the second zone II. A remaining portion of the coolant flow is led to a third flow passage 7 which has an extent round the cylinder 1 in a slitlike space between the cylinder liner 2 and a surrounding cylinder block. This third flow passage has an extent such as to result in substantially uniform cooling throughout the third zone III. The coolant flow from the upper part of the cylinder head and the coolant flow from the upper part of the cylinder liner come together in an outlet duct 8 which may be used to gather coolant from two or more cylinders and is situated at a lower level than the flow passages 5, 6, 7 in the respective zones I-III.

At least one of the parallel ducts 6 in the second highest flow passage comprises a venting duct 17. Each individual cylinder of the engine will with advantage have such a venting air duct. The various air ducts 17 from two or more cylinders may be connected to one another so that they have a shared venting duct leading upwards to an expansion tank. The result will be good venting of all the flow passages 5, 6, 7 which form part of the cooling circuit. A separate cooling circuit with a circulating cooling medium which may be coolant or an oil is used to cool the lower part of the cylinder liner. This cooling circuit has an inlet 9 which receives the medium before it goes to a fourth flow passage 10 which extends round the cylinder. This fourth flow passage leads the cooling medium into a slitlike space situated between the cylinder liner and a surrounding cylinder block and has an extent such as to result in substantially uniform cooling throughout the fourth zone IV. After the cooling medium has cooled the lower part of the cylinder liner, it is gathered in an outlet 11.

Figure 2:
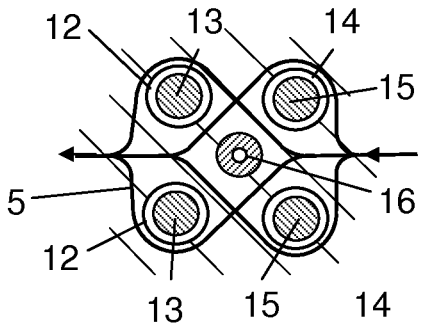
FIG. 2 depicts a sectional view through a lower part of a cylinder head and FIG. 3 depicts a cooler arrangement according to a second embodiment of the invention.

FIG. 2 depicts a cross-sectional view through the lower part of the cylinder head 3. The cylinder head has in this case two inlet ducts 12 and two inlet valves 13 to supply air to the cylinder, and two outlet ducts 14 and two exhaust valves 15 which regulate the release of exhaust gases from the cylinder in association with a combustion process. An injector 16 is provided in a central position in the cylinder to inject fuel at high pressure into the cylinder. The first flow passage comprises ducts 5 which are so arranged as to extend all the way round the inlet ducts 12, the exhaust ducts 13 and the injector 14. This first flow passage comprises also a vertical duct 5*a* which carries a vertical coolant flow round the injector 16. An elongate injector may thus be provided with good cooling. Such a vertical duct 5*a* is depicted in FIG. 1.

The cooling requirement will thus vary in the respective zones I-IV of the cylinder 1. The largest cooling requirement will be in zone I, i.e. in the lower part of the cylinder head. The cooling effect achievable with a circulating coolant is related to its temperature and flow. To provide optimum cooling effect in the lower part of the cylinder head, the whole coolant flow from the inlet 4 is initially led to the first flow passage 5. Cooling in the first zone I is thus provided by an optimum flow of coolant at a lowest possible temperature. The cooling circuit will thus impart very effective cooling in the first zone I. The next largest cooling requirement is in the third zone III, i.e. in the upper part of the cylinder liner. To provide more effective cooling in the third zone III than in the second zone II, the third flow passage 7 is so dimensioned as to receive a larger flow of coolant than the second flow passage 6. The dimensions of the third flow passage may be larger than those of the second flow passage. The coolant reaching the second zone II and the third zone III will be at the same temperature but different flows, such that the upper part of the cylinder liner is provided with more effective cooling than the upper part of the cylinder head. The smallest cooling requirement is in the lower part of the cylinder liner. As the cooling requirement here is relatively small, the separate cooling circuit may have a relatively small cooling capacity.

During operation of the engine, the cooling system conveys coolant to the cooling circuit. The cooling circuit indicated above imparts the largest cooling effect in the first zone I in the lower part of the cylinder head, the next largest cooling effect in the third zone III in the upper part of the cylinder liner and the third largest cooling effect in the second zone II in the upper part of the cylinder head. The separate cooling circuit supplies a cooling medium which provides in the fourth zone IV a smaller cooling effect than that achieved in the aforesaid zones I-III. The alternative cooling circuit may also start the circulation of the cooling medium through the fourth flow passage 10 in the lower part of the cylinder liner when the engine has reached a certain degree of warm-up after a cold start. The time the engine takes to warm up to a suitable operating temperature after a cold start may thus be shortened. The friction losses which occur during a cold start may thereby be reduced.

Figure 3:
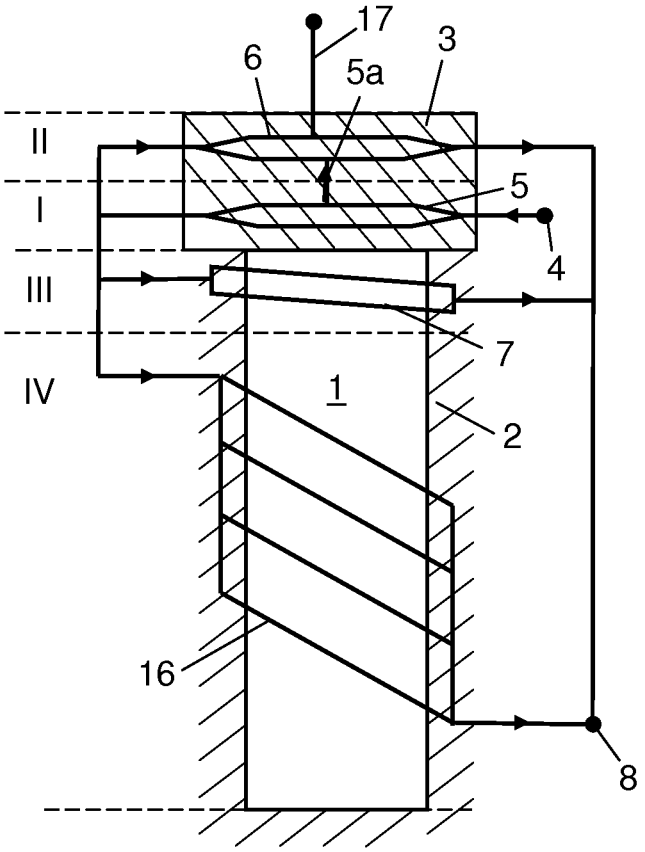

FIG. 3 depicts an alternative embodiment of the cooler arrangement which in this case comprises only one cooling circuit delivering coolant to all four zones I-IV. The configuration of the cooling circuit as regards the flow passages 5, 6, 7 in the first three zones is identical to that in FIG. 1, obviating any need for further description of those parts of the cooling circuit. Unlike the above cooling circuit, the coolant which has passed through the first zone I is in this case led also parallel to the fourth zone IV. To provide differentiated cooling in the three parallel cooled zones II-IV which receive coolant from the first zone I, the third flow passage 7 is here so dimensioned as to receive the largest coolant flow, the second flow passage 6 is here so dimensioned as to receive a smaller coolant flow than the third flow passage 7, and the fourth flow passage 10 is here so dimensioned as to receive the smallest coolant flow. The coolant from the three parallel flow passages 5, 6, 7 thereafter reaches a shared outlet 8 situated at a lower level than the lowest fourth flow passage 10 which extends through the lower part of the cylinder liner. In the flow passages there will thus be no regions of stationary coolant where pollutants might accumulate. A venting line 17 in the second highest flow passage 6 will in this case provide good venting for all of the flow passages 5, 6, 7, 10.

The invention is in way limited to the embodiment to which the drawings refer but may be varied freely within the scopes of the claims.

The invention claimed is:

1. A cooler arrangement for cooling at least one cylinder of a combustion engine, wherein said at least one cylinder has a cylinder head and a cylinder liner, wherein said cooler arrangement comprises a cooling circuit with a first flow passage which leads coolant through a lower part of the cylinder head, a second flow passage which leads coolant through an upper part of the cylinder head, and a third flow passage which leads coolant through an upper part of the cylinder liner, wherein the cooling circuit is configured to initially lead a coolant through the first flow passage before it divides the coolant into two streams for substantially simultaneous input at substantially the same temperature to both the second flow passage and the third flow passage, and wherein the second flow passage and the third flow passage are each dimensioned so that the third flow passage conducts a larger flow of coolant therethrough than a flow of coolant through the second flow passage.

2. A cooler arrangement according to claim 1 further comprising an outlet duct which is situated at a lower level than said second and third flow passages wherein the coolant leaving the second flow passage and the third flow passage is gathered in the outlet duct.

3. A cooler arrangement according to claim 1, wherein the cooler arrangement comprises a fourth flow passage which leads a cooling medium through a lower part of the cylinder liner.

4. A cooler arrangement according to claim 3, wherein the coolant leaving the first flow passage is divide into three streams for substantially simultaneous input to the second, third, and fourth flow passages respectively.

5. A cooler arrangement according to claim 3, wherein the cooler arrangement comprises a separate cooling circuit which leads a cooling medium through the fourth flow passage.

6. A cooler arrangement according to claim 1, wherein said first flow passage comprises cooling ducts which carry a parallel flow of coolant through the lower part of the cylinder head.

7. A cooler arrangement according to claim 1, wherein said first flow passage comprises cooling ducts which provide a coolant flow close to one or more inlet ducts and exhaust ducts located in the cylinder head.

8. A cooler arrangement according to claim 1, wherein said first flow passage comprises cooling ducts which provide a coolant flow close to an injector in the cylinder head.

9. A cooler arrangement according to claim 1, wherein the first flow passage comprises at least one vertical duct which leads coolant in a vertical direction close to an injector in the cylinder head.

* * * * *